US006403546B1

(12) United States Patent
Hernandez et al.

(10) Patent No.: US 6,403,546 B1
(45) Date of Patent: Jun. 11, 2002

(54) FLOOR CLEANER AND GLOSS ENHANCER

(75) Inventors: Pablo M. Hernandez, Waukegan, IL (US); Russell O. Carlsen, Racine, WI (US); Shwn-Meei Y. Linden, Racine, WI (US); Melwyn G. Turner, Racine, WI (US); Ryan E. Kron, Racine, WI (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/774,973

(22) Filed: Jan. 31, 2001

(51) Int. Cl.[7] ..... C11D 3/30; C11D 1/66; C11D 3/43

(52) U.S. Cl. ..... 510/214; 510/201; 510/205; 510/207; 510/217; 510/238; 510/240; 510/421; 510/432; 510/433; 510/499

(58) Field of Search ..... 510/214, 201, 510/205, 207, 217, 238, 240, 421, 432, 433, 499

(56) References Cited

U.S. PATENT DOCUMENTS

| | | | | | |
|---|---|---|---|---|---|
| 2,383,114 | A | | 8/1945 | De Villiers | 252/118 |
| 3,711,436 | A | * | 1/1973 | Oliver et al. | 260/28.5 R |
| 3,926,893 | A | * | 12/1975 | Woodward | 260/29.6 R |
| 4,070,510 | A | * | 1/1978 | Kahn | 427/385 R |
| 4,230,605 | A | | 10/1980 | Connolly et al. | 252/545 |
| 4,747,880 | A | | 5/1988 | Berrido et al. | 106/207 |
| 4,784,798 | A | | 11/1988 | Geke et al. | 252/544 |
| 4,853,145 | A | | 8/1989 | Schmid et al. | 252/136 |
| 4,857,114 | A | | 8/1989 | Brumbaugh et al. | 134/42 |
| 4,861,518 | A | | 8/1989 | Morganson et al. | 252/548 |
| 5,342,551 | A | | 8/1994 | Ruckle | 252/548 |
| 5,382,376 | A | | 1/1995 | Michael et al. | 252/153 |
| 5,782,991 | A | | 7/1998 | van der Heyden et al. | 134/37 |

FOREIGN PATENT DOCUMENTS

| | | | |
|---|---|---|---|
| EP | 0 239 084 A2 | 9/1987 | C09G/1/04 |

OTHER PUBLICATIONS

Four pages of an advertisement by Essential Industries, Inc. entitled Floor Maintenance Systems, admitted prior art.

Twenty–three pages including questions and answers describing a Top Guard product by Top Guard Products, admitted prior art.

Four pages from Spartan Chemical News describing a SunSwept product, admitted prior art.

Eight pages describing a Taski Wiwax cleaning and maintenance Emulsion, by Lever Industrial, admitted prior art.

* cited by examiner

*Primary Examiner*—Charles Boyer
(74) *Attorney, Agent, or Firm*—Neil E. Hamilton; Warren R. Bovee; Renee J. Rymarz

(57) ABSTRACT

A composition for cleaning and enhancing the gloss of floors wherein a plasticizer can both clean and enhance gloss of a floor coating. In a preferred embodiment the plasticizer is tributoxyethyl phosphate.

14 Claims, No Drawings

FLOOR CLEANER AND GLOSS ENHANCER

BACKGROUND OF THE INVENTION

1. Technical Field

This invention relates to compositions for cleaning and enhancing the gloss of floors. More particularly it relates to a composition of the foregoing type which provides improved cleaning and gloss enhancing properties.

BACKGROUND ART

It is known in the prior art to use various ingredients such as polyacrylate polymer, wax, surfactant, solvents and plasticizers to enhance gloss and in some cases to also clean floors.

U.S. Pat. No. 4,747,880 discloses a floor care product which both cleans and shines. It includes an alkaline builder such as sodium carbonate, which is blended with an alkali-soluble polymer or resin, such as a styrene-acrylic acid copolymer, which functions as a film former. In U.S. Pat. No. 4,230,605 there is disclosed a floor cleaning composition which includes a terpolymer composed of methyl methacrylate, butyl acrylate and acrylic acid together with a surfactant which includes diethanolamine. U.S. Pat. No. 4,861,518 discloses a non-filming floor cleaner which includes non-ionic surfactants with monoethanolamine or ethylene glycol monobutyl ether and polyethylene glycol. In U.S. Pat. No. 5,342,551 there is disclosed a floor finish remover which utilizes glycol ethers as solvents and monoethanolamine citrate.

The prior art does not provide a composition for cleaning and enhancing the gloss of floors wherein a plasticizer acts in conjunction with other ingredients to provide not only gloss enhancement but give unexpected cleaning results on floor tile that has previously been coated with and without traditional floor finishes.

The objects of the invention therefore are:

a. Providing an improved composition for cleaning and enhancing the gloss of floors.

b. Providing a composition for cleaning and enhancing the gloss of floors which results in improved cleaning of the floor tile that has previously been coated with and without traditional floor finishes with additional gloss enhancement.

c. Providing a composition of the foregoing type which affords improved maintenance of floors.

d. Providing a composition of the foregoing type which affords gloss retention.

e. Providing a composition of the foregoing type which can be easily formulated into concentrates and diluted resulting in cost reduction.

f. Providing a composition of the foregoing type which obviates deleterious effects to the floor finish or substrate.

These and still other objects and advantages of the invention will be apparent from the description which follows. In the detailed description below preferred embodiments of the invention will be described in reference to the full scope of the invention. Rather, the invention may be employed in other embodiments.

SUMMARY OF THE INVENTION

The shortcomings of the prior art are overcome and the foregoing objects are accomplished by the composition of this invention which can clean and enhance the gloss of floors. In one embodiment, the composition includes 0.1–30% by weight of a glycol solvent, 0.1–30% of a plasticizer which can both clean and enhance gloss of a floor coating, 0.1–30% of a nonionic surfactant, an amine, and optionally water.

In another embodiment, the plasticizer is a tributoxyethyl phosphate and the glycol solvent is diethylene glycol monoethyl ether.

In a preferred embodiment, the glycol solvent is diethylene glycol monobutyl ether.

In still another embodiment, the nonionic surfactant is a $C_8$–$C_{15}$ hydrocarbon with 1 to 10 moles of ethoxylation and the amine is diethanolamine.

In yet another embodiment, there is included an amide having a $C_8$–$C_{20}$ hydrocarbon chain and the amide is a diethanolamine amide of oleic acid which is also known as cocamide diethanolamine.

In still another embodiment, there is included a high melting point oxidized polyethylene wax.

In yet another embodiment, the composition includes ethylene diamine triacetic acid, as well as a coloring agent and a fragrance.

DESCRIPTION OF PREFERRED EMBODIMENTS

The following Table 1 illustrates in Ex. 1 one of the preferred formulas of this invention as well as other pertinent formulas in Exs. 2–7 that have been used to validate the Ex. 1 formula versus cleaning protocols. Essentially the cleaning regiment is to coat clean white vinyl composition tiles ("VCT") tiles with a Floor Finish (6 coats of 0.0003–0.0005 in. thick each coat) and allowed to dry for one hour per coat. The tiles are soiled with fine graphite either dry applied or suspended in a water mixture. The formulations are then diluted and tiles are cleaned by covering the tile with the diluted solution. A red pad is used with a Gardner scrubber tester to simulate cleaning. Other pads can also be used including brushes and sponges. Before and after cleaning reflectance readings are taken with Minolta CR 200 Colorimeter. This instrument is able to detect slight variations in color and in this case from white to black/gray.

The formulas in Table 1 vary from an alkaline cleaner in Ex. 3 to some commercial available maintainers on the market such as those illustrated in Exs. 5, 6 and 7. Included also are Exs. 2 and 4 which are used in North America and Europe. The Ex. 2 product has many of the same ingredients found in the Ex. 1 product with the major difference of not containing tributoxyethyl phosphate (Trade Name KP-140). The Ex. 3 cleaner is an example of standard cleaners used for cleaning burnished and unburnished floors. It is composed of solvent, surfactant and amines/ammonia. The Ex. 4 product is more of a traditional floor maintainer, which contains surfactant but also, an acrylate polymer and high melting point polyethylene wax. The product of Ex. 5 is an example of a maintainer, which does contain tributoxyethyl phosphate ("KP-140") but strictly as a plasticizer. The other products of Exs. 6 and 7 show the general class of maintainers and their cleaning performance. Various dilutions were run as these products have a variety of diluted uses, from 1:8 to 1:128. Only the Ex. 1 and 2 products are super concentrates that have the ability to be able to be diluted beyond the traditional dilutions and still show cleaning.

The Ex. 1 product shows cleaning performance which goes beyond the traditional alkaline cleaner type and neutral cleaners that has other key benefits in terms of gloss enhancement and still not attack the coating.

The product of Ex. 1 is prepared by introducing the glycol ether to a suitable vessel with agitation. The cocamide diethanolamine is added followed by the addition of the KP-140, Tergitol 15-S-9. Subsequently, the water is added and then the EDTA, fragrance and dye. Similar procedures are employed in preparing the products of Exs. 2–14.

TABLE 1

| Ingredient and/or Supplier | Chemical Composition and/or Function | Ex. 1 % Wt | Ex. 2 % Wt | Ex. 3 % Wt | Ex. 4 % Wt | Ex. 5 % Wt | Ex. 6 % Wt | Ex. 7 % Wt |
|---|---|---|---|---|---|---|---|---|
| Diethylene Glycol Mono Ethyl Ether | Solvent | 17.4 | 20 | | | | | |
| Ethylene Glycol Mono Butyl Ether | Solvent | | | 20 | | | | |
| Ethylene Di-Glycol | Solvent | | | | | | | 2 |
| Tributoxyethyl Phosphate | Plasticizer | 5.2 | | | | X | | 1 |
| Cocamide Diethanolamine | C8–C20 Hydrocarbon Chain of Diethanol Amide of Oleic Acid/Emulsifier | 7.8 | | | | | | |
| Monoethanolamine | Alkaline Neutralizer | | | 35.2 | | | | |
| Ammonia | Alkaline Neutralizer | | | 3.4 | | | | >0.1 |
| C11 Alcohol Ethoxylate (6 EO) | Surfactant | | | 6 | 5 | | | |
| C11 Alcohol Ethoxylate (8 EO) | Surfactant | | | | 1.5 | | | |
| Tergitol 15-S-9/Union Carbide | Secondary Alcohol C12–C14 Ethoxylate with 9 Moles of Ethoxylation/Surfactant | 6 | 15.6 | | | | X | |
| Fatty Alcohol Alkoxylate | Surfactant | | | | 1 | | | |
| Octyl Glucoside (65%) | Surfactant | | | | 0.6 | | | |
| Ester Alcohol | Surfactant | | | | | X | | |
| Coconut Fatty Acids | Emulsifier | | | | 0.6 | | | |
| Tetrasodium EDTA | Chelant Agent/Hard Water Control | 0.32 | 0.64 | | | | | |
| Acrylate Polymer | Dispersant | | | 1 | | | | |
| Sodium Hydroxide (47%) | Alkaline Neutralizer | | | | 0.51 | | | |
| Acrylic Polymer | Film Former | | | | 11.2 | X | | |
| Styrene Acrylic Copolymer (20% Active) | Film Former | | | | | | X | 20 |
| Polyethylene Wax Emulsion (30% Active) | | | | | 2.1 | | | 20 |
| Polypropylene Wax Emulsion (30% Active) | | | 21 | | 6.3 | X | X | |
| Fragrance | | 0.12 | 0.12 | 0.3 | >.1 | | | |
| Dye | | >.01 | >0.1 | >0.1 | >0.1 | | | |
| Deionized Water | | To 100% | To 100% | To 100% | To 100% | To 100% | To 100% | To 100% |
| Percent Cleaning-Premia Floor Finish/ Johnson Wax Professional | Acrylic - Wax Finish | | | | | | | |
| 1:8 | | | | | 27.91 | | | |
| 1:32 | | | 43.71 | | 20.69 | 5.6 | | |
| 1:64 | | | | | | | | |
| 1:100 | | | | | | | 9.04 | |
| 1:128 | | 30.59 | 18.59 | | | | | |
| 1:256 | | 19.91 | 15.52 | 17.61 | 0.68 | | | |
| 1:512 | | 12.99 | 12.6 | 9.08 | | | | |

In Table 1, X's used in Examples 5 and 6 signify that an ingredient is contained within their formulation. There are no amounts for these ingredients because they are commercial products from Spartan Chemical Co. and Lever Industries, respectively. No specific amounts of each ingredient used are indicated on the label.

TABLE 1A

| Ingredient and/or Supplier | Chemical Composition and/or Function | Ex. 8 % Wt | Ex. 9 % Wt | Ex. 10 % Wt | Ex. 11 % Wt | Ex. 12 % Wt | Ex. 13 % Wt | Ex. 14 % Wt | Ex. 15 % Wt |
|---|---|---|---|---|---|---|---|---|---|
| Carbitol | Diethylene Glycol Mono Ethyl Esther/ Solvent | 17.4 | 17.4 | 17.4 | 17.4 | 17.4 | 17.4 | 17.4 | |
| Ninol 1281/Stephan | Amide/Emulsifier | 7.8 | 12.5 | 7.8 | 7.8 | 7.8 | 7.8 | 7.8 | |
| Neodol 91-6/Tohmah Chemical | C9–C11 Alcohol Ethoxylate with 6 Moles of Ethoxylation/Surfactant | 7.0 | 9.0 | 6.0 | 6.0 | 6.0 | 6.0 | 6.0 | |
| Neodol 91-2.5/Tohmah Chemical | C9–C11 Alcohol Ethoxylate with 25 Moles of Ethoxylation/Surfactant | | | | | | | | |
| DI Water | | 52.4 | 53.5 | 60.0 | 62.8 | 62.8 | 62.8 | 62.8 | |
| Oleic Acid | Plasticizer | 6.0 | | | | | | | |
| Napthalene Sulfonate, 50% | Hydrotrope - Coupler | 7.8 | | | | | | | |
| Dibutyladipate | Plasticizer | | 6.0 | | | | | | |
| Rhodafac RS-610/Rhone Poulenc | Plasticizer | | | | 5.2 | | | | |
| Rodafac RS-710/Rhone Poulenc | Plasticizer | | | | | 5.2 | | | |
| Rodafac RD-960/Rhone Poulenc | Plasticizer | | | | | | 5.2 | | |
| Benozoflex 2088/Velsicol | Plasticizer | | | | | | | 5.2 | |
| Iso Decyl Benzoate/Velsicol | Plasticizer | | | 6.0 | | | | | |
| 4 Na EDTA, 40% | Chelant Agent/Hard Water Control | 1.6 | 1.6 | 2.8 | 0.8 | 0.8 | 0.8 | 0.8 | |
| Ethylene Glycol mono Butyl Ether/ | | | | | | | | | 20.0 |
| Dow Monoethanolamine/Dow | | | | | | | | | 35.2 |
| Ammonia | | | | | | | | | 3.4 |
| C11 Alcohol Ethoxylate (6E0)/ Tomah | | | | | | | | | 6.0 |
| Acrylate Dispersant/Rohm & Haas | | | | | | | | | 1.0 |
| Fragrance | | | | | | | | | 0.3 |

TABLE 1A-continued

| Ingredient and/or Supplier | Chemical Composition and/or Function | Ex. 8 % Wt | Ex. 9 % Wt | Ex. 10 % Wt | Ex. 11 % Wt | Ex. 12 % Wt | Ex. 13 % Wt | Ex. 14 % Wt | Ex. 15 % Wt |
|---|---|---|---|---|---|---|---|---|---|
| Dye | | | | | | | | | <0.1 |
| Deionized Water | | | | | | | | | To 100% |
| Percent Cleaning - Premia Floor Finish/Johnson Wax Professional 1:512 | Acrylic - Wax Finish | 21.89 | 21.83 | 12.61 | 14.48 | 23.87 | 13.33 | 9.09 | 18.61 |

In Table 1A seven various plasticizers were compared on the ability to clean and to enhance gloss. Note that even though the use of different plasticizers in the Examples show varying levels of cleaning ability there is no gloss enhancement with respect to these plasticizers. Example 15 of Table 1A is used for comparison it is only a cleaner it has no gloss enhancing elements. It shows the cleaning effectiveness of a straight cleaner and its lack of effect on gloss enhancement.

In Table 2, four products were compared on the ability to enhance gloss. These are the products of Exs. 1, 2, 4 and 7. Note that the product of Ex. 1 even when it was diluted to a higher dilution still showed higher gloss enhancement than the other products on unfinished tiles.

TABLE 2

| Product | Dilution | Finish at time of testing | Gloss (Average) 20° | 60° | 85° | % Increase 20° | 60° | 85° |
|---|---|---|---|---|---|---|---|---|
| Ex. 1 | 1:256 | No Finish | 0.25 | 3.55 | 32.3 | | | |
| | | Initial | 2.1 | 14.55 | 53.4 | 740 | 309 | 65.3 |
| | | Buff | 2.65 | 17.3 | 57.7 | 960 | 387 | 78.6 |
| Ex. 2 | 1:128 | No Finish | 0.25 | 3.55 | 32.3 | | | |
| | | Initial | 1.5 | 10.05 | 48.05 | 500 | 183 | 48.7 |
| | | Buff | 2.7 | 16.85 | 55.45 | 980 | 374 | 71.67 |
| Ex. 4 | 1:32 | No Finish | 0.25 | 3.55 | 32.3 | | | |
| | | Initial | 1.7 | 11.9 | 50.55 | 580 | 235 | 56.5 |
| | | Buff | 5.8 | 13.8 | 54.5 | 2220 | 288 | 68.73 |
| Ex. 7 | 1:128 | No Finish | 0.25 | 3.55 | 32.3 | | | |
| | | Initial | 1.8 | 12.5 | 52.6 | 620 | 252 | 62.8 |
| | | Buff | 1.75 | 13.85 | 54.9 | 600 | 290 | 70 |

The following procedure was employed in testing the products of Table 2. A Black VCT floor was stripped and cleaned and the following steps were taken. First, a Clark Auto-scrubber was filled with the above diluted product Examples. Second, floor was sectioned off into 25 feet sections. Third, the scrubber was equipped with a red cleaning pad at 100 lbs. of down pressure and each of the cleaners were scrubbed and immediately picked off the floor via vacuuming. Then after the initial application a second and third repeat scrubbing was done. Fourth after the third application a polishing machine (1500 rpm) was passed over the treated surface three times. Throughout the testing process gloss readings were taken on the floor initially, after third application and after burnishing.

Table 3 shows other versions and formulations which investigated the effect of various key ingredients and cleaning performance. The most effective cleaning is seen with the use of the KP-140 as a key ingredient. The amount and type of surfactant used affects cleaning performance with the preference of nonionic surfactant showing best results. Amines show also a positive effect but not as significant as the use of the tributoxyethyl phosphate and surfactant. The wax component is not critical for cleaning in that in all formulas containing this ingredient did not show significant cleaning increase.

TABLE 3

| Ingredient | Ex. 16 % Wt | Ex. 17 % Wt | Ex. 18 % Wt | Ex. 19 % Wt | Ex. 20 % Wt | Ex. 21 % Wt | Ex. 22 % Wt |
|---|---|---|---|---|---|---|---|
| Diethylene Glycol Mono Ethyl Ether | 5 | 5 | 5 | | 8.67 | 8.94 | 8.67 |
| Ethylene Glycol Mono Butyl Ether | | | | 2 | | | |
| Ethylene Glycol Mono Hexyl Ether | | | | 1 | | | |
| Tributoxyethyl Phosphate | | | 6 | 6 | 6 | 6 | 2.6 |
| Cocamide Diethanolamine | 3.9 | 3.9 | | | 3.9 | 3.9 | 3.9 |
| Diethanolamine | | 1.65 | 1.65 | 1.65 | | | |
| Ammonia (28% Active) | 0.45 | 0.45 | 0.45 | 0.45 | | | |
| Tergitol 15-S-9 | 3.9 | | 8 | 8 | 8 | 8 | |
| Tetrasodium EDTA | 0.4 | 0.4 | 0.4 | 0.4 | 0.4 | 0.4 | 0.4 |
| Polypropylene Wax Emulsion (30% Active) | 5.25 | 5.25 | 5.25 | 5.25 | 5.25 | | 2.6 |
| Deionized Water | To 100% | To 100% | To 100% | To 100% | To 100% | To 100% | To 100% |
| Percent Cleaning-Premia Floor Finish 1:32 | 29.97 | 28.45 | 97.66 | 96.95 | 81.67 | 79.84 | 24.12 |

In Table 4, several of the variations were evaluated for gloss enhancement with wax showing an increase in gloss as compared to formulas having low or no wax whatsoever.

TABLE 4

| Product | Results | Average 20° Gloss | % Increase | Average 60° Gloss | % Increase |
|---|---|---|---|---|---|
| Ex. 2 | Initial Gloss | 19 | | 59.6 | |
| | Before Scratch | 38.3 | 101.6 | 73.8 | 23.8 |
| | Final Gloss | 42.3 | 122.6 | 75.5 | 26.7 |
| Ex. 12 | Initial Gloss | 18 | | 57.5 | |
| | Before Scratch | 36.5 | 102.8 | 72.5 | 26.1 |
| | Final Gloss | 38 | 111.1 | 73.5 | 27.8 |
| Ex. 13 | Initial Gloss | 20.5 | | 59.5 | |
| | Before Scratch | 32 | 56.1 | 70.5 | 18.5 |
| | Final Gloss | 38.5 | 87.8 | 72.5 | 21.8 |
| Ex. 14 | Initial Gloss | 22 | | 63 | |
| | Before Scratch | 37.5 | 70.5 | 75.5 | 19.8 |
| | Final Gloss | 44.5 | 102.3 | 76 | 20.6 |

The following procedure was employed in testing the products of Table 4. Tiles were coated with 2-coats of Premia Floor Finish, dried and burnished. Cleaner/gloss enhancer was applied and then dried and burnished for 4 cycles followed by scratching the surface with a blue stripping pad. Finally reapplication of solution followed by burnishing for additional 4 cycles for a total of 8 cycles. All dilutions were run at 1:32.

Table 5 depicts the adverse role of alkalinity in combination with solvent and surfactant in a cleaner and its ability to strip floor finish from a floor. Although alkalinity has historically been used to increase cleaning it does have deleterious effects. Note that even though the product of Ex. 1 has solvent, surfactant and low alkalinity it has no adverse effect on a tile coated with Premia Floor Finish. This is ideal in that the prior art teaches that effective cleaners usually are composed of either alkaline ingredients or combined with solvents to enhance the cleaning of hard surfaces. This technology shows that although alkalinity can improve cleaning it is not a key ingredient in getting good cleaning which is beneficial in that floor finishes and equipment used show no deleterious effects.

The following procedure was employed in testing the products of Table 5. First, a VCT Tile was cleaned and stripped. Second, 5 coats of Premia Floor Finish was applied after each coat was applied the tiles were marked with a number that corresponded to the coat. Tiles were then allowed to dry for 48 hours after which the tiles were cut into 2"×12" stripped and put into a Gardner Scrubber and dilutions of the cleaner/maintainer were allowed to sit on the tiles for 5 minutes. Finally the tiles were scrubbed with a light cleaning pad (red) for 25 cycles and the number of coats removed were recorded.

TABLE 5

Results

| Product | Dilution | Number of Coats Removed |
|---|---|---|
| Ex. 1 | 1:512 | 0 |
| Ex. 3 | 1:512 | 1 |

While tributoxyethyl phosphate is the preferred plasticizer for both cleaning and enhancing the gloss of a floor coating, other plasticizers can be employed as shown in the Examples of Tables 1, 1A and 3.

INDUSTRIAL APPLICABILITY

The compositions of this invention are useful in both cleaning and enhancing the gloss of a floor coating. They can be diluted with water and still provide cleaning and gloss enhancement.

What is claimed is:

1. A composition for cleaning and enhancing the gloss of floors consisting essentially of:

0.1–30% by weight of a glycol solvent;

0.1–30% of a plasticizer which can both clean and enhance gloss of a floor coating;

0.1–30% of a nonionic surfactant;

an amine; and optionally water.

2. The composition as defined in claim 1 wherein the plasticizer is a tributoxyethyl phosphate.

3. The composition as defined in claim 1 wherein the glycol solvent is diethylene glycol monoethyl ether.

4. The composition as defined in claim 1 wherein the glycol solvent is ethylene glycol monobutyl ether and ethylene glycol monohexyl ether.

5. The composition as defined in claim 1 wherein the nonionic surfactant is a $C_8$–$C_5$ hydrocarbon with 1 to 10 moles of ethoxylation.

6. The composition as defined in claim 1 wherein the amine is diethanolamine.

7. The composition as defined in claim 1 wherein the amine is cocamide diethanolamine.

8. The composition as defined in claim 1 further including an amide having a $C_8$–$C_{20}$ hydrocarbon chain.

9. The composition as defined in claim 8 wherein the amide is a diethanolamine amide of oleic acid.

10. The composition as defined in claim 1 further including waxes.

11. The composition as defined in claim 10 wherein the wax includes high melting point polyethylene or polypropylene.

12. The composition as defined in claim 1 further including ethylenediamine triacetic acid.

13. The composition as defined in claim 1 further including a coloring agent and a fragrance.

14. A method of cleaning and enhancing the gloss of floors comprising contacting the floor with the composition of claim 1.

* * * * *

UNITED STATES PATENT AND TRADEMARK OFFICE

CERTIFICATE OF CORRECTION

PATENT NO. : 6,403,546 B1
DATED : June 11, 2002
INVENTOR(S) : Pablo M. Hernandez et al.

It is certified that error appears in the above-identified patent and that said Letters Patent is hereby corrected as shown below:

Column 8,
Line 21, replace "C8-C5" with -- C8-C15 --.

Signed and Sealed this

Twenty-second Day of November, 2005

JON W. DUDAS
*Director of the United States Patent and Trademark Office*